US009846982B2

(12) United States Patent
Cooper

(10) Patent No.: US 9,846,982 B2
(45) Date of Patent: Dec. 19, 2017

(54) DOCUMENT GEOMETRIC DEFORMATION WATERMARKING AND TRACKING

(71) Applicant: NCR Corporation, Duluth, GA (US)

(72) Inventor: Jeffrey Cooper, Kitchener (CA)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 14/927,755

(22) Filed: Oct. 30, 2015

(65) Prior Publication Data

US 2017/0124795 A1 May 4, 2017

(51) Int. Cl.
*G07D 7/2033* (2016.01)
*G07D 7/20* (2016.01)
*G07D 7/00* (2016.01)

(52) U.S. Cl.
CPC ..... *G07D 7/0073* (2013.01); *G07D 7/2008* (2013.01); *G07D 7/2033* (2013.01)

(58) Field of Classification Search
None
See application file for complete search history.

(56) References Cited

U.S. PATENT DOCUMENTS 6,754,365 B1 * 6/2004 Wen ..... G06T 1/0078 382/100
8,806,517 B2 * 8/2014 Petrovic ..... H04H 20/14 725/107
2002/0073319 A1 * 6/2002 Manabe ..... H04L 63/123 713/176
2003/0065747 A1 * 4/2003 Sakamoto ..... G06F 17/30864 709/219
2003/0213841 A1 * 11/2003 Josephson ..... G06Q 20/042 235/379
2007/0291979 A1 * 12/2007 Thorwirth ..... G11B 20/00086 382/100
2008/0183650 A1 * 7/2008 Komamura ..... G06Q 10/10 706/21
2009/0089585 A1 * 4/2009 Kogure ..... G06T 1/0071 713/176
2010/0266168 A1 * 10/2010 Wang ..... G06K 9/001 382/124
2011/0167274 A1 * 7/2011 Swamidas ..... H04L 63/08 713/176

(Continued)

FOREIGN PATENT DOCUMENTS

GB 2434662 A * 8/2007 ..... G06F 21/36

*Primary Examiner* — Michelle M Hausmann
(74) *Attorney, Agent, or Firm* — Schwegman, Lundberg & Woessner; Paul W. Martin

(57) ABSTRACT

Various embodiments herein each include at least one of systems, methods, and software that assists in identification of a source of an unauthorized disclosure of a document, such as a public disclosure of check, receipt, or other document type. One method embodiment includes receiving a request for a stored document image from a requestor and retrieving the requested stored document image. This method may then apply a parameterized image deformation algorithm according to at least one input parameter to generate a watermarked image and then stores the at least one parameter and an identifier of the requestor in association with an identifier of the requested stored document in a watermarked image log. The watermarked image is then transmitted to the requestor.

20 Claims, 5 Drawing Sheets

(56) References Cited

U.S. PATENT DOCUMENTS

| | | | | |
|---|---|---|---|---|
| 2011/0188703 | A1* | 8/2011 | Yang | H04N 21/2347<br>382/100 |
| 2013/0279759 | A1* | 10/2013 | Kagarlitsky | G06K 9/6202<br>382/105 |
| 2016/0352754 | A1* | 12/2016 | Kim | H04L 63/20 |

* cited by examiner

DOCUMENT GEOMETRIC DEFORMATION WATERMARKING AND TRACKING

BACKGROUND INFORMATION

Disclosure of document images, such as check, invoice, and receipt images and related documents can be a significant privacy problem. Knowledge of who gave how much money to whom, and even for what, may be of interest to media organizations, business competitors, and criminals alike. Steganographic techniques have been used to conceal tracking data within documents and documents images using many steganographic techniques. However, such techniques often fail due to poor quality reproduction of compromised documents and document images, awareness and redaction of steganographic markers, and the like.

SUMMARY

Various embodiments herein each include at least one of systems, methods, and software that assists in identification of a source of an unauthorized disclosure of a document, such as a public disclosure of check, receipt, or other document type.

One method embodiment includes receiving a request for a stored document image from a requestor and retrieving the requested stored document image. This method may then apply a parameterized image deformation algorithm according to at least one input parameter to generate a watermarked image and then stores the at least one parameter and an identifier of the requestor in association with an identifier of the requested stored document in a watermarked image log. The watermarked image is then transmitted to the requestor.

Another method embodiment includes receiving a compromised image and correlating the compromised image to the stored document image. This method may then process at least one of the compromised and stored images such that both the compromised and stored document images have the same vertical and horizontal properties. The method then retrieves each of the at least one parameters and respective requestor identifier for each entry in the watermarked image log including an identifier of the stored document image correlated to the compromised image. The parameterized image deformation algorithm is then applied against the stored document image for each of the at least one parameters retrieved to generate comparison images of the stored document image. This method then compares each comparison image to the processed compromised image to generate a matching score. When the comparing results in a score meeting a matching criterion, the method outputs at least the requestor identifier associated in the watermarked image log with the at least one parameter applied by the parameterized deformation algorithm in generating the respective comparison image.

DETAILED DESCRIPTION

Figure 1:
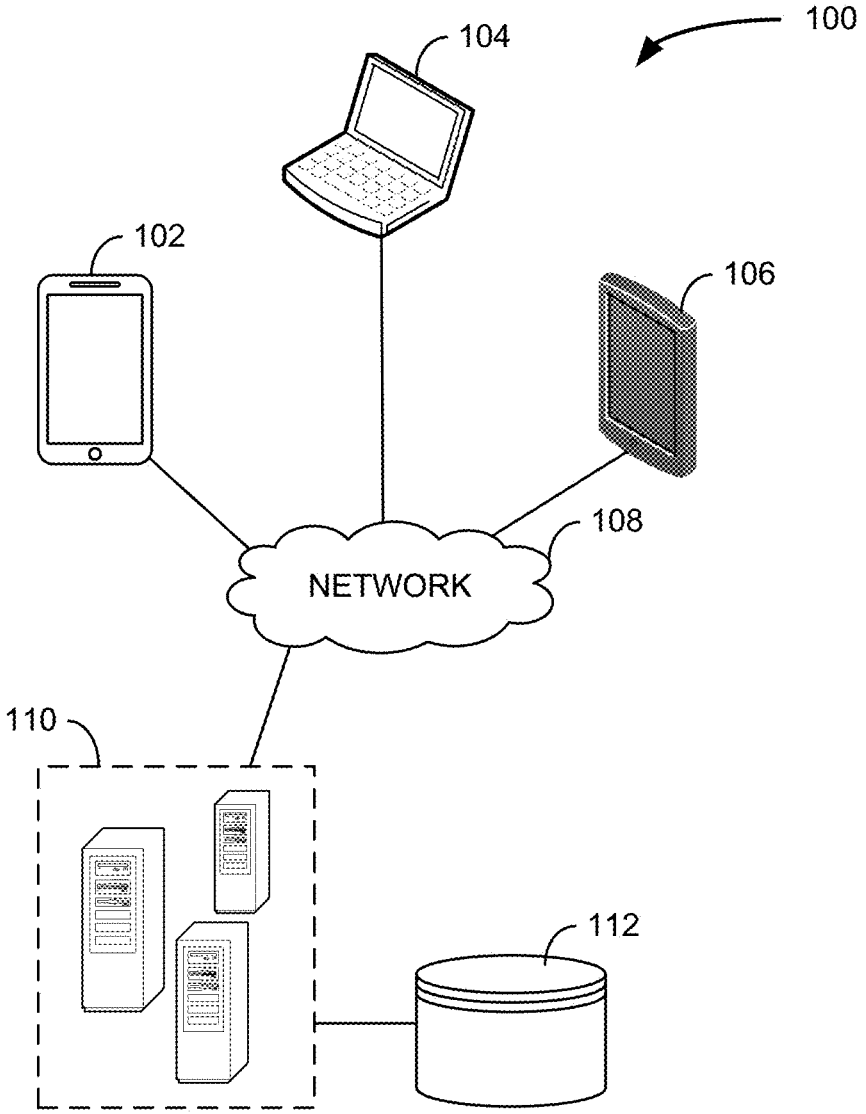
FIG. 1 is an architectural diagram of a system, according to an example embodiment.

In various embodiments herein, one objective is to hide a signature in plain view such that it is transferred even when lower fidelity photos or image conversion is performed. As an example, the signature will remain even when a document image viewer takes a picture of a document or a document image presented on a computer screen with a smartphone phone or other camera. This type action would not normally be traceable.

Some embodiments herein use a new steganography technique to add a unique signature to an image every time an image is downloaded by a computer system and presented either on a screen or in print form. The steganographic signature is recorded in an audit facility so that when an information disclosure is being investigated, the disclosed image may be traced to a specific access by a user at a recorded time and date.

In some such embodiments, exact matching is not necessary as even narrowing the field of candidate accesses can be of great help in an investigation. For example, a blurry cell phone picture may be difficult to match exactly, but maybe 70% of accesses are ruled out allowing the investigation to focus on the remaining 30%.

The steganography technique utilized in some embodiments herein includes geometrically deforming a retrieved document image, such as an image of a check or receipt, before providing the image to a requesting computer system user. The geometric deformation is typically performed by a parameterized process that is provided with unique parameters that specify how the geometric deformation is to be performed. This may include one more values that indicate an amplitude of a particular deformation type (e.g., stretch, compress, swirl, Bezier curve, etc.) and may even identify one or more particular deformation-types to apply. The parameters, an image identifier, a requesting user identifier, and a date-time-stamp are then recorded in an audit trail or log to enable reproduction of the geometrically deformed document image and tracking back to the image access by the particular user. Note that the geometric deformation is made to provide a signature tracking mechanism but to still maintain legibility of the document image.

Later, should a document image be compromised, an image of the compromised document can be matched to the original document and the audit trail can be utilized to regenerate the documents with their signatures to enable comparison with an image of the compromised document. This comparison may identify the user who disclosed the compromised document or narrow the possible users that disclosed the compromised document.

These and other embodiments are described and illustrated herein.

In the following detailed description, reference is made to the accompanying drawings that form a part hereof, and in which is shown by way of illustration specific embodiments in which the inventive subject matter may be practiced. These embodiments are described in sufficient detail to enable those skilled in the art to practice them, and it is to be understood that other embodiments may be utilized and that structural, logical, and electrical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims.

The functions or algorithms described herein are implemented in hardware, software or a combination of software and hardware in one embodiment. The software comprises computer executable instructions stored on computer readable media such as memory or other type of storage devices. Further, described functions may correspond to modules, which may be software, hardware, firmware, or any combination thereof. Multiple functions are performed in one or more modules as desired, and the embodiments described are merely examples. The software is executed on a digital signal processor, ASIC, microprocessor, or other type of processor operating on a system, such as a personal computer, server, a router, or other device capable of processing data including network interconnection devices.

Some embodiments implement the functions in two or more specific interconnected hardware modules or devices with related control and data signals communicated between and through the modules, or as portions of an application-specific integrated circuit. Thus, the exemplary process flow is applicable to software, firmware, and hardware implementations.

FIG. 1 is an architectural diagram of a system 100, according to an example embodiment. The illustrated architecture of the system 100 is an illustration of a simple embodiment. Other embodiments may include more complex architectures spanning several networks, computer systems, and numerous clients.

The system 100 includes clients 102, 104, 106 that may be utilized to generate or capture document images, such as images of checks, invoices, receipts, specifications, contracts, and other documents. The clients 102, 104, 106 may then transmit captured or generated document images via a network 108, such one or more of the Internet, Local Area Network, or other network, to a backend system 110 that stores image copies and tracks accessing thereof.

The clients 102, 104, 106 are illustrated as a smartphone 102, a personal computer 104, and a tablet 106. However, some embodiments may include other client-types, such as self-service terminals (SSTs) such as automated teller machines (ATMs) and self-checkout terminals. Such SSTs may include imaging devices to generate images of presented checks, generated receipts, and the like. The clients may also include check imaging devices utilized to process checks by payment processing entities. Other client types may also be present in other embodiments.

The backend system 110 may be a standalone document image management system or may be a part of another system, such as a banking system, a customer relationship management system, an accounting system, an Enterprise Resource Management system, a document management system, and the like. The backend system 110 may be deployed to one or more physical or virtual computing device in various embodiments. The backend system 110 may store image and log data locally thereon, on one or more databases 112, or a combination thereof.

When a client 102, 104, 106 user wants to view a document image, the user manipulates an application or app on their respective client 102, 104, 106 to request a document image. The document image may be retrieved by a unique document identifier, such as a check number, an index number, file name, or other identifier. The client 102, 104, 106 app or application, which may be a web browser-accessible application, upon receipt of input to request a document image generates and sends a request to the backend system 110 via the network 108. The request will include or be associated with data identifying the requested document and the user requesting the document. The backend system 110 then retrieves the requested document and geometrically deforms the document to watermark the document image that will be provided as is discussed in greater detail below. The backend system 110 then logs the access of the document in a watermarked image log with the document identifier, the user identifier, parameters utilized in geometrically deforming the document, and a date time stamp. The backend system 110 then transmits the geometrically deformed document image to the client 102, 104, 106 of the requesting user.

Later, the document image provided to the requesting user may be compromised. An image of the compromised document can be processed according to various embodiment herein to match the compromised document image to an instance where a user requested to view the original document, or at least reduce the number of viewing users from consideration when investigating to identify the compromising source. At a high level the matching process, which is also described in greater detail below, includes a user providing a compromised document image via a client 102, 104, 106. The user may then identify the original document stored by the backend system 110 that was compromised and submit the compromised image document and the original document identifier to the backend system 110. The backend system 110 then processes at least one of the compromised and original document images so that the two images have the same resolution, size, and to remove any skewing in the compromised document image. Skewing refers to the documents having a trapezoidal or other shape in the compromised document image that can occur when a camera or other imaging device that captured the image was at an angle or was rotated when capturing the image. One way to consider this processing is normalization of the images to enable likewise comparison.

The backend system 110 then retrieves watermark image log data associated with the original document. This retrieved data includes the parameters utilized in geometrically deforming the document image, a user identifier, and a date time stamp. In some embodiments, the backend system 110 may eliminate retrieved data that has a date time stamp after a date and time the compromised image was known to have been compromised. The remaining retrieved data, or all of the retrieved data when no data has been eliminated, is then utilized to generate a comparison image for each logged data document viewing. The comparison images are then compared to the compromised document image to identify a match or that match according to a scoring algorithm where the score is at or above a matching threshold. The comparison in some embodiments, includes an image subtraction. For example, the images may be in or converted to a binary black and white form. Since the images have been processed to be of the same size, shape, and resolution, one image may be subtracted from the other image (i.e., pixel by pixel subtraction). When the score is zero, this indicates an absolute match. Absolute matching is likely to be a rare occurrence as reproduction of images, especially by taking pictures or scanning of documents and images of documents rarely results in a perfect reproduction. However, when the result indicates a 70% or greater matching, the possibility of a match may be deemed quite likely. The percentage of matching pixels' indicative of a likely match is a threshold in some embodiments, and that threshold may be adjusted in some embodiments.

In some instances, one image may not be aligned well with the pixels of the other image. Thus, in some embodiments, the processing of the images before the comparing is performed may include an alignment of the images for comparing. This may include shifting some or all pixels of one image up or down and left or right.

When an actual or deemed likely or potential match is identified, the backend system outputs the watermark image log data associated with therewith. The backend system may output the data back to the client 102, 104, 106 of the user that submitted the compromised document image or otherwise notify that user or one or more other users.

Figure 2:
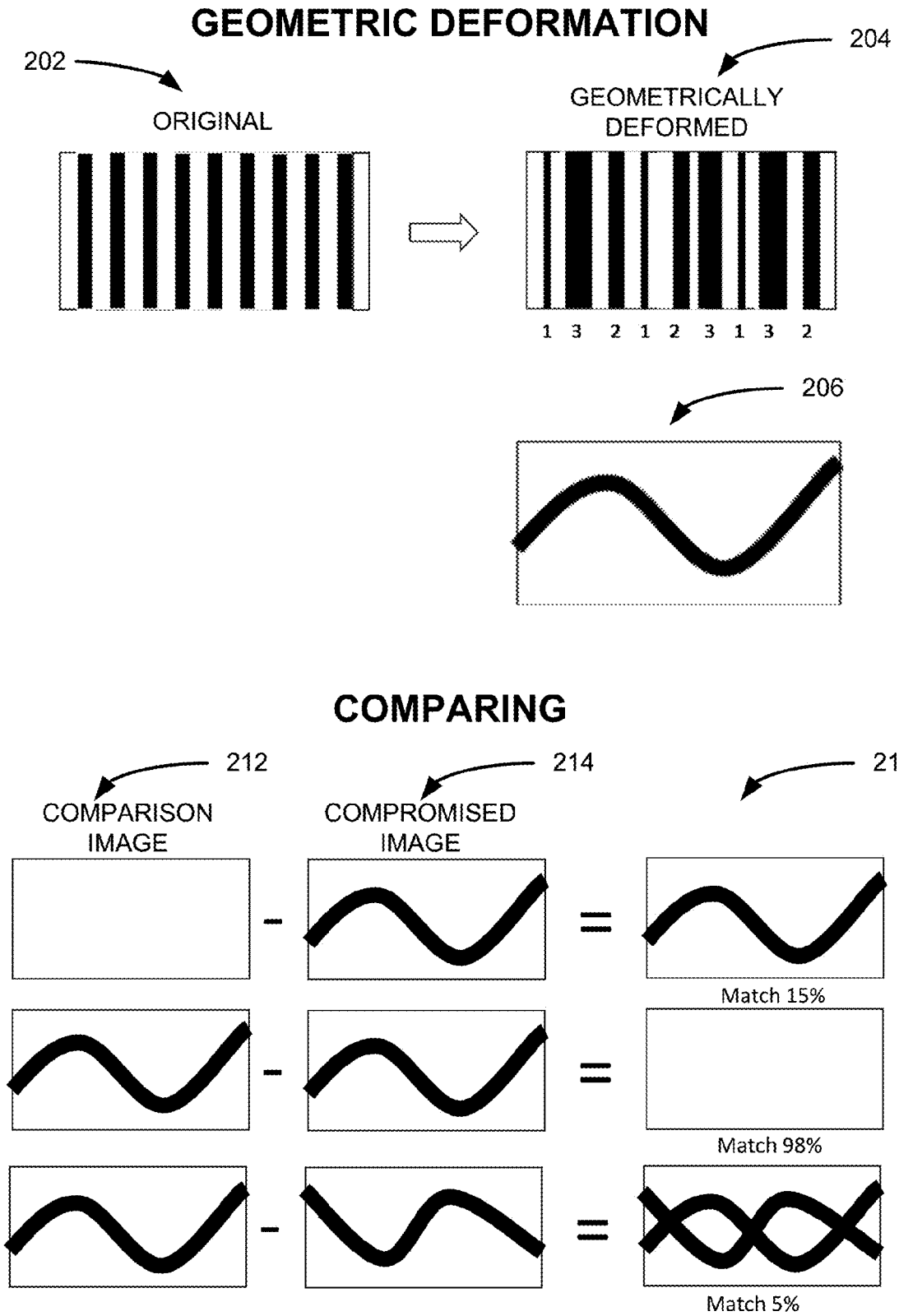
FIG. 2 includes example image illustrations and logical expressions of image processing, according to some example embodiments.

FIG. 2 includes example image illustrations and logical expressions of image processing, according to some example embodiments.

The top portion of FIG. 2 illustrates examples of geometric deformation. An original image 202 is modified through a geometric deformation that alternately stretches or compresses areas of the image in a pattern. The pixel offset and axis of the stretching is parameterized in some embodiments from a randomly generated and unique signature. In a simple form, deformation of a barcode image where the black band width is uniform in the original image 202, but stretched or compressed in the resulting, geometrically deformed image 204. The geometric deformation applied that results in the image 204 is performed by a geometric deformation algorithm that breaks the width of the document up into vertical bands. Each band is either compressed or stretched according to a parameter. The parameters utilized in arriving at the image 204 are included in the illustration below the image 204. These parameters are a value that indicates a width the band is to have following the processing. Note that 1 indicates to compress, 2 indicates no compression or stretching, and 3 indicates stretching. If the original image 202 included text, the same text would be present in the resulting image 204 in a legible, although distorted form. The resulting image 204 therefore would still convey the information of the document but through the processes described herein, would be traceable back to a document viewing event.

Note however that the above example is greatly exaggerated. The transition between deforming will typically be more gradual and the amount of stretching below the threshold where it will be obviously visible.

Note as well that the signature, in some embodiments, is randomly generated according to well known random number and value generation techniques. The signature is recorded in a watermarked image log, as mentioned above, with time, date, viewing user, and image identifying data.

The compressing and stretching of an image such as is applied to arrive at the image 204 above is but one example of a type of geometric deformation that can be applied. Other embodiments may include modifying the axis of the bands to yield a completely different signature, such as orienting the stretching and compressing at an angle (e.g., 30, 45, or 90 degrees). Different angles and orientations also yield unique signatures and can be one parameter of the signature.

Additionally, bands are not the only form of geometric deformation. Alternatives include circular, elliptical, along an irregular boundary or curve, and the like. The parameters of the curve form part of the signature that is recorded. Another example is a Bezier curve superimposed on the image where pixels are stretched away from the normal of the curve, such as illustrated by image 206.

Now with reference to the bottom portion of FIG. 2, example embodiments of comparing are illustrated. After an information disclosure event wherein an image is compromised, the compromised image is matched with an audit record. To perform this action, the compromised document image is processed into a rectangular, de-skewed image matching the resolution and dimensions of the original image. Comparison images 212 are generated for each audit record from the original image and then the difference for each against the compromised image 214 is performed. The closest match 216 identifies the likely audit event of the disclosure.

Figure 3:
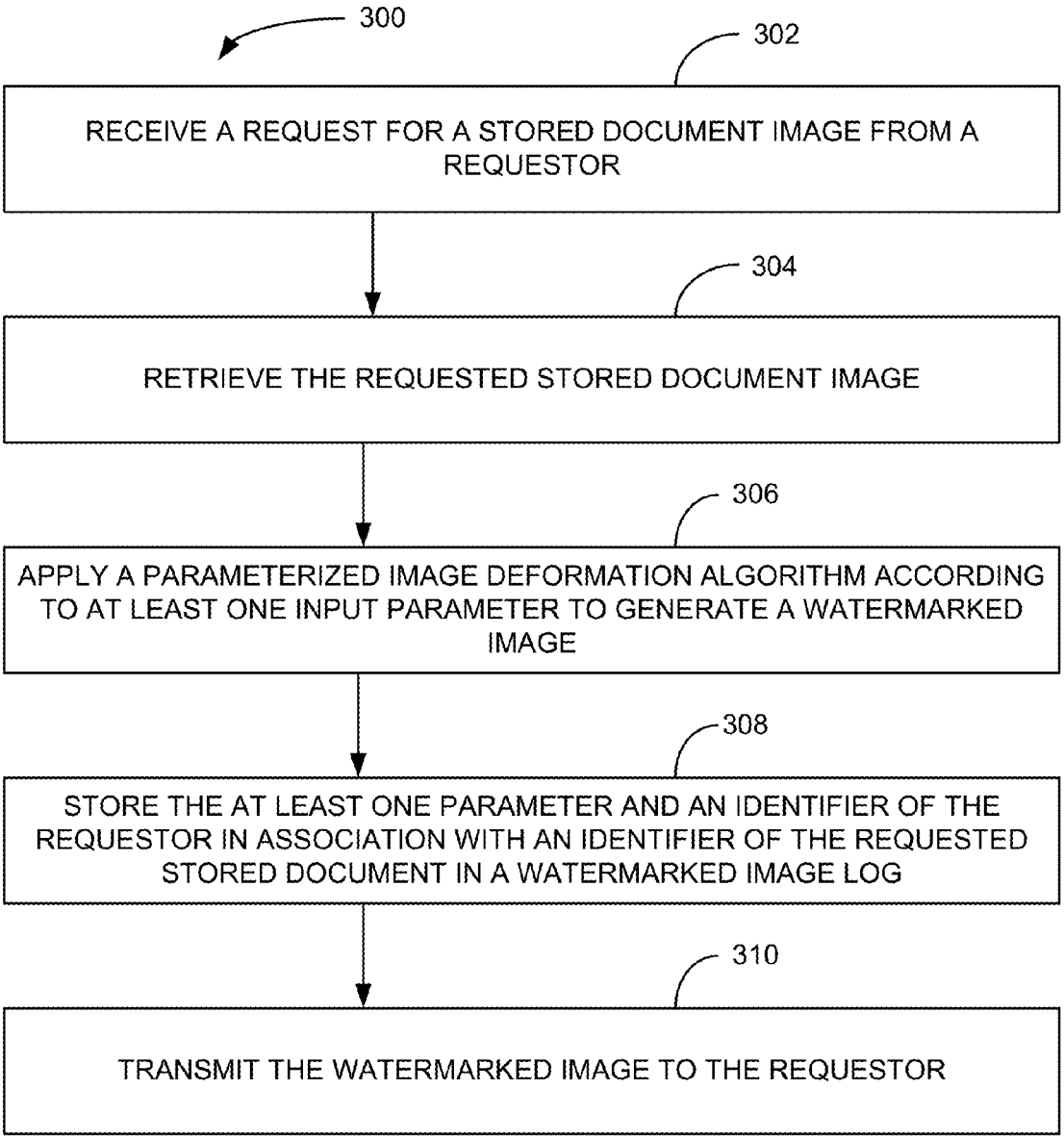
FIG. 3 is a block flow diagram of a method, according to an example embodiment.

FIG. 3 is a block flow diagram of a method 300, according to an example embodiment. The method 300 is an example of a method performed in some embodiments when a client 102, 104, 106 user requests a document image via the network 108 from the backend system 110 of FIG. 1.

The method 300, in some embodiments, includes the backend system 110 receiving 302 a request for a stored document image via the network 108 from a requestor (i.e., a user of a client 102, 104, 106). The backend system 110 then retrieves 304 the requested stored document image from storage and applies 306 a parameterized image deformation algorithm according to at least one input parameter to generate a watermarked image. The input parameter may be one or more randomly generated values, tracked incremented values, and the like that are programmatically obtained and provided as input arguments to the parameterized image deformation algorithm. The method 300 then stores 308 the at least one parameter and an identifier of the requestor in association with an identifier of the requested stored document in a watermarked image log. A date time stamp or similar data may also be stored 308 to the watermarked image log. The method 300 then transmits 310 the watermarked image to the requestor via the network 108.

In some embodiments of the method 300, an original document of the stored document image includes a representation of a unique identifier of the original document and the identifier of the requested stored document is the unique identifier of the original document. The unique identifier may be a check number which may also include an account number, a file name, and other unique data item identifier types.

In some embodiments, the parameterized image deformation algorithm geometrically deforms the stored document image to a degree as specified by each of the at least one parameters. In one such embodiment, at least one of the parameters specifies at least one geometric deformation method to be applied to deform the stored document image, such as a banded or Bezier curve geometric deformation method as described above. In some such embodiments, at least one parameter identifies an amplitude of geometric deformation to be applied to the stored document image.

Figure 4:
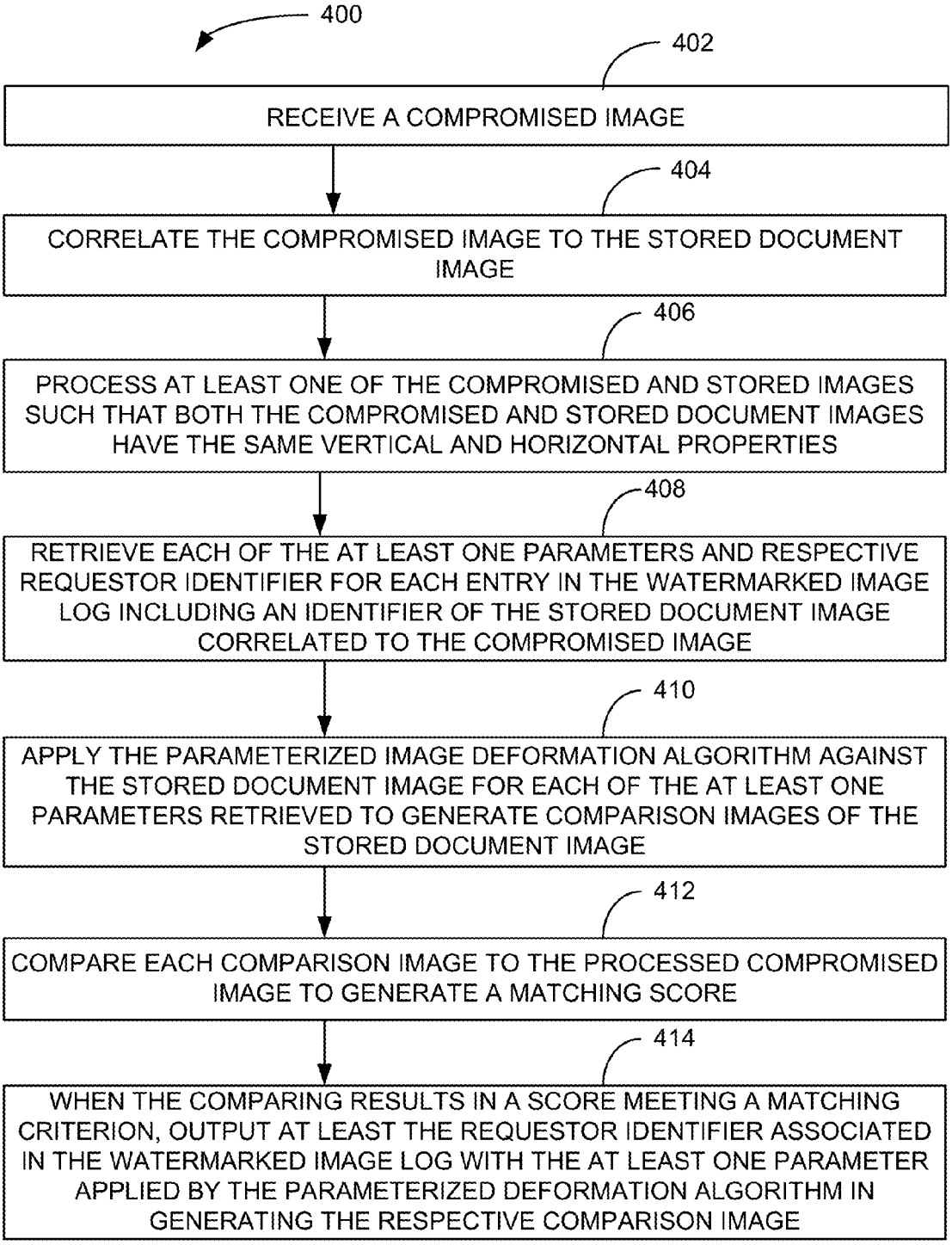
FIG. 4 is a block flow diagram of a method, according to an example embodiment.

FIG. 4 is a block flow diagram of a method 400, according to an example embodiment. The method 400 is an example of a method that may be performed on a backend system 110 of FIG. 1. Note however, that all or a portion of the method 400, as well as the method 300, may be performed on a client 102, 104, 106 computing device in some embodiments.

FIG. 4 is a block flow diagram of a method 400, according to an example embodiment. The method 400 is an example of a method that may be performed on a backend system 110 of FIG. 1. Note however, that all or a portion of the method 400, as well as the method 300, may be performed on a client 102, 104, 106 computing device in some embodiments.

The method 400, in some embodiments, includes receiving 402 a compromised image and correlating 404 the compromised image to the stored document image. The compromised image may be received 402 from a client 102, 104, 106 user and the correlating 404 may be based on received user input or by reading data from the compromised image, such as by performing optical character recognition. The method 400 then processes 406 at least one of the compromised and stored images such that both the compromised and stored document images have the same vertical and horizontal properties.

The method 400 then retrieves 408 each of the at least one parameters and respective requestor identifier for each entry in the watermarked image log including an identifier of the stored document image correlated to the compromised image. Next, the method 400 applies 410 the parameterized image deformation algorithm against the stored document image for each of the at least one parameters retrieved to generate comparison images of the stored document image. Comparing 412 is then performed with regard to each comparison image and the processed compromised image to generate a matching score. When the comparing results in a score meeting a matching criterion, the method 400 outputs 414 at least the requestor identifier associated in the watermarked image log with the at least one parameter applied by the parameterized deformation algorithm in generating the respective comparison image.

Figure 5:
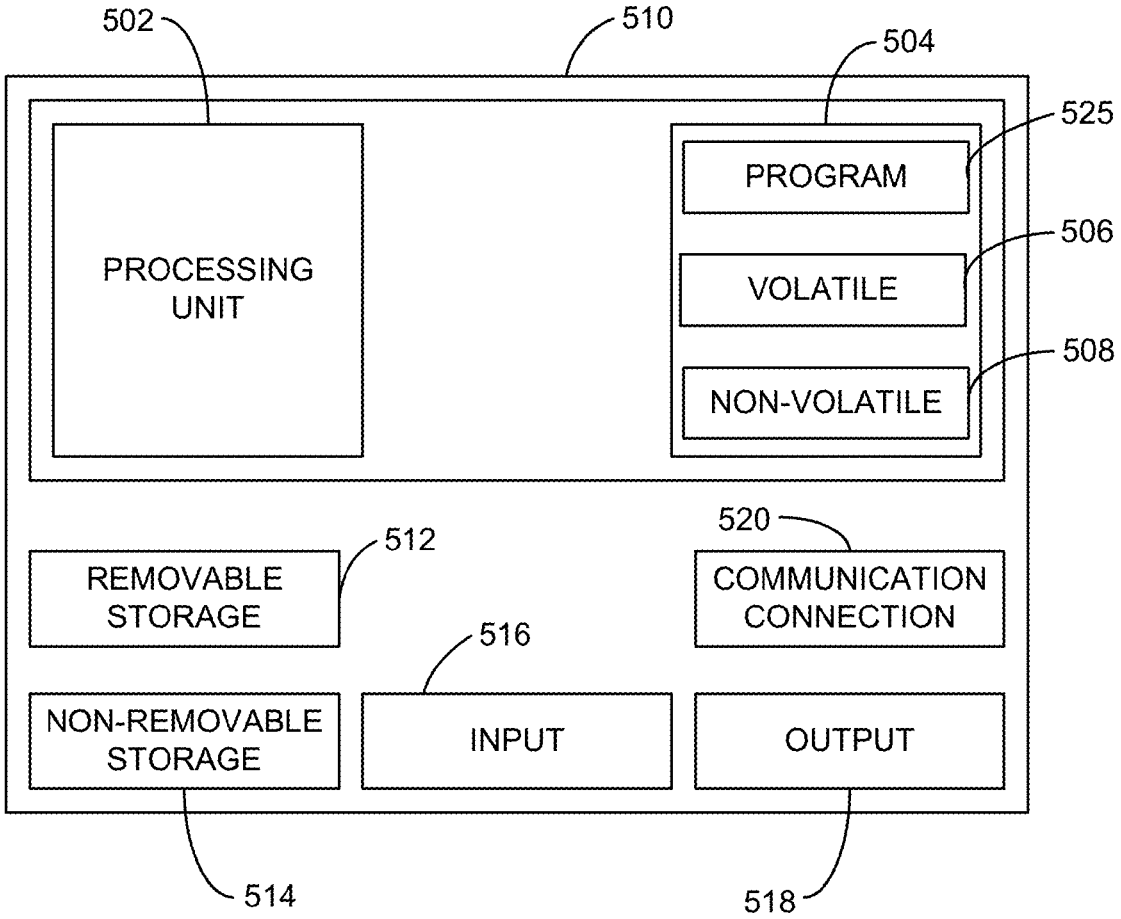
FIG. 5 is a block diagram of a computing device, according to an example embodiment.

FIG. 5 is a block diagram of a computing device, according to an example embodiment. In one embodiment, multiple such computer systems are utilized in a distributed network to implement multiple components in a transaction-based environment. An object-oriented, service-oriented, or other architecture may be used to implement such functions and communicate between the multiple systems and components. One example computing device in the form of a computer 510, may include a processing unit 502, memory 504, removable storage 512, and non-removable storage 514. Although the example computing device is illustrated and described as computer 510, the computing device may be in different forms in different embodiments. For example, the computing device may instead be a smartphone, a tablet, smartwatch, or other computing device including the same or similar elements as illustrated and described with regard to FIG. 5. Devices such as smartphones, tablets, and smartwatches are generally collectively referred to as mobile devices. Further, although the various data storage elements are illustrated as part of the computer 510, the storage may also or alternatively include cloud-based storage accessible via a network, such as the Internet.

Returning to the computer 510, memory 504 may include volatile memory 506 and non-volatile memory 508. Computer 510 may include—or have access to a computing environment that includes a variety of computer-readable media, such as volatile memory 506 and non-volatile memory 508, removable storage 512 and non-removable storage 514. Computer storage includes random access memory (RAM), read only memory (ROM), erasable programmable read-only memory (EPROM) and electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage or other magnetic storage devices, or any other medium capable of storing computer-readable instructions.

Computer 510 may include or have access to a computing environment that includes input 516, output 518, and a communication connection 520. The input 516 may include one or more of a touchscreen, touchpad, mouse, keyboard, camera, one or more device-specific buttons, one or more sensors integrated within or coupled via wired or wireless data connections to the computer 510, and other input devices. The computer 510 may operate in a networked environment using a communication connection 520 to connect to one or more remote computers, such as database servers, web servers, and other computing device. An example remote computer may include a personal computer (PC), server, router, network PC, a peer device or other common network node, or the like. The communication connection 520 may be a network interface device such as one or both of an Ethernet card and a wireless card or circuit that may be connected to a network. The network may include one or more of a Local Area Network (LAN), a Wide Area Network (WAN), the Internet, and other networks. In some embodiments, the communication connection 520 may also or alternatively include a transceiver device, such as a BLUETOOTH® device that enables the computer 510 to wirelessly receive data from and transmit data to other BLUETOOTH® devices.

Computer-readable instructions stored on a computer-readable medium are executable by the processing unit 502 of the computer 510. A hard drive (magnetic disk or solid state), CD-ROM, and RAM are some examples of articles including a non-transitory computer-readable medium. For example, various computer programs 525 or apps, such as one or more applications and modules implementing one or more of the methods illustrated and described herein or an app or application that executes on a mobile device or is accessible via a web browser, may be stored on a non-transitory computer-readable medium.

It will be readily understood to those skilled in the art that various other changes in the details, material, and arrangements of the parts and method stages which have been described and illustrated in order to explain the nature of the inventive subject matter may be made without departing from the principles and scope of the inventive subject matter as expressed in the subjoined claims.

What is claimed is:

1. A method comprising:

receiving a request for a stored document image containing private information of a person and an identifier of the stored document image from a requestor;

retrieving the requested stored document image;

applying a parameterized image deformation algorithm according to at least one input parameter to generate a unique watermarked image containing the private information and the identifier of the stored document image;

storing the at least one parameter and an identifier of the requestor in association with the identifier of the requested stored document in a watermarked image log following generation of the watermarked image;

transmitting the watermarked image to the requestor;

determining from the watermarked image log the identifier of the requestor based upon the identifier of the requested stored document when the watermarked image transmitted to the requestor becomes compromised;

receiving a compromised image;

correlating the compromised image to the stored document image;

processing at least one of the compromised and stored images such that both the compromised and stored document images have the same vertical and horizontalproperties;

retrieving each of the at least one parameters and respective requestor identifier for each entry in the watermarked image log including an identifier of the stored document image correlated to the compromised image;

applying the parameterized image deformation algorithm against the stored document image for each of the at least one parameters retrieved to generate comparison images of the stored document image;

comparing each comparison image to the processed compromised image to generate a matching score; and when the comparing results in a score meeting a matching criterion, outputting at least the requestor identifier associated in the watermarked image log with the at least one parameter applied by the parameterized deformation algorithm in generating the respective comparison image.

2. The method of claim 1, wherein each of the at least one input parameters is a randomly generated value.

3. The method of claim 1, wherein:

an original document of the stored document image includes a representation of a unique identifier of the original document; and the identifier of the requested stored document is the unique identifier of the original document.

4. The method of claim 1, wherein the parameterized image deformation algorithm geometrically deforms the stored document image to a degree as specified by each of the at least one parameters.

5. The method of claim 4, wherein at least one of the parameters specifies at least one geometric deformation method to be applied to deform the stored document image.

6. The method of claim 4, wherein at least one parameter identifies an amplitude of geometric deformation to be applied to the stored document image.

7. The method of claim 1, wherein processing at least one of the compromised and stored images such that both the compromised and stored document images have the same vertical and horizontal properties includes:

resizing at least one of the compromised and stored document images to have the same size and resolution when the compromised and stored document images differ in size or resolution; and de-skewing at least one of the compromised and stored document images to have the same shape when the compromised and stored document images havediffering shapes.

8. The method of claim 1, wherein the matching criterion defines a score threshold indicative of a possible match.

9. The method of claim 1, wherein the matching criterion provides that the highest matching score identifies which requestor identifier is to be output.

10. The method of claim 1, wherein the comparing includes a pixel by pixel comparison between a comparison image and the processed compromised image.

11. A method comprising:

applying an image deformation algorithm according to at least one input parameter to a stored document image containing private information of a person and an identifier of the stored document image in response to a request from a requestor to generate a unique watermarked image containing the private information and the identifier of the stored document image;

storing the at least one parameter and an identifier of the requestor in association with the identifier of the requested stored document in a watermarked image log following generation of the watermarked image;

transmitting the watermarked image to the requestor;

determining from the watermarked image log the identifier of the requestor based upon the identifier of the stored document image when the watermarked image transmitted to the requestor becomes compromised;

receiving a compromised image;

correlating the compromised image to the stored document image;

processing at least one of the compromised and stored images such that both the compromised and stored document images have the same vertical and horizontal properties;

retrieving each of the at least one parameters and respective requestor identifier for each entry in the watermarked image log including an identifier of the stored document image correlated to the compromised image;

applying the image deformation algorithm against the stored document image for each of the at least one parameters retrieved to generate comparison images of the stored document image;

comparing each comparison image to the processed compromised image to generate a matching score; and when the comparing results in a score meeting a matching criterion, outputting at least the requestor identifier associated in the watermarked image log with the at least one parameter applied by the deformation algorithm in generating the respective comparison image.

12. The method of claim 11, wherein each of the at least one inputparameters is a unique parameter.

13. The method of claim 11, wherein the stored document image is an image of a check.

14. The method of claim 11, wherein processing at least one of the compromised and stored images such that both the compromised and stored document images have the same vertical and horizontal properties includes:

resizing at least one of the compromised and stored document images to have the same size and resolution when the compromised and stored document images differ in size or resolution; and de-skewing at least one of the compromised and stored document images to have the same shape when the compromised and stored document images have differing shapes.

15. A system comprising:

at least one processor, at least one memory device, and at least one network interface device;

instructions stored on the at least one memory device that are executable by the at least one processor to perform data processing activities comprising:

receiving, via the at least one network interface device, a request for a stored document image containing private information of a person and an identifier of the stored document image from a requestor;

retrieving the requested stored document image from the at least one memory device;

applying a parameterized image deformation algorithm according to at least one input parameter to generate a unique watermarked image containing the private information and the identifier of the stored document image;

storing the at least one parameter and an identifier of the requestor in association with the identifier of the requested stored document in a watermarked image log following generation of the watermarked image, the watermarked image log stored on the at least one memory device;

transmitting, via the at least one network interface device, the watermarked image to the requestor;

determining from the watermarked image log the identifier of the requestor based upon the identifier of the stored document image when the watermarked image transmitted to the requestor becomes compromised;

receiving a compromised image file;

correlating the compromised image to the stored document image by data represented in the compromised image file;

processing at least one of the compromised and stored images such that both the compromised and stored document images have the same vertical andhorizontal properties;

retrieving, from the at least one memory device, each of the at least one parameters and respective requestor identifier for each entry in the watermarked image log including an identifier of the stored document image correlated to the compromised image;

applying the parameterized image deformation algorithm against the stored document image for each of the at least one parameters retrieved to generate comparison images of the stored document image;

comparing each comparison image to the processed compromised image to generate a matching score for each comparison image; and when the comparing of a comparison image and the processed compromised image results in a score meeting a matching criterion, outputting at least the requestor identifier associated in the watermarked image log with the at least one parameter applied by the parameterized deformation algorithm in generating the respective comparison image.

16. The system of claim 15, wherein processing at least one of the compromised and stored images such that both the compromised and stored document images have the same vertical and horizontal properties includes:

resizing at least one of the compromised and stored document images to havethe same size and resolution when the compromised and stored document images differ in size or resolution; and de-skewing at least one of the compromised and stored document images to have the same shape when the compromised and stored document images have differing shapes.

17. The system of claim 15, wherein the comparing includes a pixel by pixel comparison between a comparison image and the processed compromised image.

18. A method comprising:

receiving a request for a stored document image from a requestor;

retrieving the requested stored document image;

applying a parameterized image deformation algorithm according to at least one input parameter to generate a watermarked image;

storing the at least one parameter and an identifier of the requestor in association with an identifier of the requested stored document in a watermarked image log;

transmitting the watermarked image to the requestor;

receiving a compromised image;

correlating the compromised image to the stored document image;

processing at least one of the compromised and stored images such that both the compromised and stored document images have the same vertical and horizontalproperties;

retrieving each of the at least one parameters and respective requestor identifier for each entry in the watermarked image log including an identifier of the stored document image correlated to the compromised image;

applying the parameterized image deformation algorithm against the stored document image for each of the at least one parameters retrieved to generate comparison images of the stored document image;

comparing each comparison image to the processed compromised image to generate a matching score; and when the comparing results in a score meeting a matching criterion, outputting at least the requestor identifier associated in the watermarked image log with the at least one parameter applied by the parameterized deformation algorithm in generating the respective comparison image.

19. A method comprising:

applying an image deformation algorithm according to at least one input parameter to a stored document image in response to a request from a requestor to generate a watermarked image;

storing the at least one parameter and an identifier of the requestor in association with an identifier of the requested stored document in a watermarked image log; and transmitting the watermarked image to the requestor;

receiving a compromised image;

correlating the compromised image to the stored document image;

processing at least one of the compromised and stored images such that both the compromised and stored document images have the same vertical and horizontal properties;

retrieving each of the at least one parameters and respective requestor identifier for each entry in the watermarked image log including an identifier of the stored document image correlated to the compromised image;

applying the image deformation algorithm against the stored document image for each of the at least one parameters retrieved to generate comparison images of the stored document image;

comparing each comparison image to the processed compromised image to generate a matching score; and when the comparing results in a score meeting a matching criterion, outputting at least the requestor identifier associated in the watermarked image log with the at least one parameter applied by the deformation algorithm in generating the respective comparison image.

20. A system comprising:

at least one processor, at least one memory device, and at least one network interface device;

instructions stored on the at least one memory device that are executable by the at least one processor to perform data processing activities comprising:

receiving, via the at least one network interface device, a request for a stored document image from a requestor;

retrieving the requested stored document image from the at least one memory device;

applying a parameterized image deformation algorithm according to at least one input parameter to generate a watermarked image;

storing the at least one parameter and an identifier of the requestor in association with an identifier of the requested stored document in a watermarked image log, the watermarked image log stored on the at least one memory device; and transmitting, via the at least one network interface device, the watermarked image to the requestor;

receiving a compromised image file;

correlating the compromised image to the stored document image by data represented in the compromised image file;

processing at least one of the compromised and stored images such that both the compromised and stored document images have the same vertical and horizontal properties;

retrieving, from the at least one memory device, each of the at least one parameters and respective requestor identifier for each entry in the watermarked image log including an identifier of the stored document image correlated to the compromised image;

applying the parameterized image deformation algorithm against the stored document image for each of the at least one parameters retrieved to generate comparison images of the stored document image;

comparing each comparison image to the processed compromised image to generate a matching score for each comparison image; and when the comparing of a comparison image and the processed compromised image results in a score meeting a matching criterion, outputting at least the requestor identifier associated in the watermarked image log with the at least one parameter applied by the parameterized deformation algorithm in generating the respective comparison image.

* * * * *